United States Patent [19]

Drury

[11] 4,164,393

[45] Aug. 14, 1979

[54] PRESERVATIVE FOR HIDES

[75] Inventor: Emma-Jane E. Drury, Rochester, N.Y.

[73] Assignee: Eastman Kodak Company, Rochester, N.Y.

[21] Appl. No.: 897,064

[22] Filed: Apr. 17, 1978

[51] Int. Cl.[2] ..... C14C 1/00

[52] U.S. Cl. ..... 8/94.18; 8/94.1 R

[58] Field of Search ..... 8/94.18, 94.1 R

[56] References Cited

U.S. PATENT DOCUMENTS

| | | | |
|---|---|---|---|
| 2,722,483 | 11/1955 | Winkler | 426/532 |
| 3,404,987 | 10/1968 | Kodistra et al. | 426/549 |
| 3,483,003 | 12/1969 | Ziffer et al. | 99/150 |
| 3,697,651 | 10/1972 | Khan et al. | 424/128 |
| 3,920,388 | 11/1975 | Weaver et al. | 8/94.15 |
| 4,083,999 | 4/1978 | Drury et al. | 426/532 |

OTHER PUBLICATIONS

T. C. Thorstensen, "Practical Leather Technology", (Krieger Publishing Co., New York), 1976, pp. 30–41.

The Merck Index (Ninth Edition), 1976, p. 796, No. 5972.

*Primary Examiner*—A. Lionel Clingman

*Attorney, Agent, or Firm*—John F. Stevens; Daniel B. Reece, III

[57] ABSTRACT

Disclosed is a composition for preserving animal hides comprising propionic acid, sorbic acid, and preferably dehydroacetic acid and methyl paraben. This composition is used in aqueous floats containing the hides.

12 Claims, No Drawings

PRESERVATIVE FOR HIDES

BACKGROUND OF THE INVENTION

1. Field of the Invention

This invention relates to the preservation of animal hides. More specifically, this invention relates to compositions in which the hides are soaked to preserve leather-making properties and to substantially reduce or eliminate microbial contamination.

2. Description of the Prior Art

It is well known that salt may be used for the preservation of hides. There is a need, however, to substantially reduce or eliminate the levels of dissolved solids in tannery or packing house effluents. It is also well known that the action of soaking liquor on animal hides and skin in the manufacture of leather articles can be improved by modifying the soaking liquor with various additives. U.S. Pat. No. 4,083,999 discloses a method of treating animal feedstuff to prevent growth of mold using a mixture of certain acids, for example, sorbic and propionic. It is also known that propionic acid is antimicrobial (U.S. Pat. Nos. 3,483,003 and 3,697,651); that sorbic acid is a food preservative (U.S. Pat. No. 3,404,987); and dehydroacetic acid is antimicrobial in foods and beverages (U.S. Pat. Nos. 3,474,228 and 2,722,483). The Merck Index (an encyclopedia of chemicals and drugs published by Merck & Co., Inc., Rahway, N.J.) indicates that methyl paraben is a preservative in foods, etc.

Problems of a unique nature are encountered in attempts to preserve animal hides, especially unwashed hides from freshly slaughtered animals. It is common to encounter hide deterioration caused by, at least in part, manure, blood, flesh tissues, dirt and other waste material associated with animals. The compositions of the present invention, however, substantially reduce effluent problems associated with the use of many preservatives, does not substantially affect the quality of the hides, and is effective for a substantial length of time.

SUMMARY OF THE INVENTION

I have now discovered that a mixture of propionic acid and sorbic acid, preferably in combination with dehydroacetic acid and methyl paraben, is an effective composition for the preservation of animal hides for periods of 30 days or more. It is particularly preferred to use the mixture of all four ingredients for several reasons. The use of a relatively large quantity of any particular ingredient is avoided. Use of a relatively large quantity of a particular ingredient sometimes has a deteriorating effect on hides. For example, it is believed that use of relatively large quantities of propionic acid, e.g., 2.5%, may break down the integrity of hides. Also, propionic acid is much more corrosive to equipment than dehydroacetic acid or methyl paraben. Furthermore, propionic acid is much more volatile than dehydroacetic acid or methyl paraben and hence its effect is much shorter in time. Thus, it is desired to keep the amount of propionic acid used relatively low.

It is well known in the art that freshly removed animal hides deteriorate rapidly because of enzyme and microbial action. The nature of the acquisition of hides contributes greatly to the factors causing the deterioration. For example, the enzymes and microbial cells present in the hide and in the blood and those that arise from the contaminating debris and manure particles in the hide and the hair are contributing factors. The grain layer, which is the most highly prized part of the hide for leather-making purposes, is usually the first part of the hide to be attacked. Consequently, a method of preventing deterioration and subsequent damage to the hide and especially to the grain layer is an important contribution to leather technology and manufacture.

The safety factor and exposure to infection of workers handling the hides is an important consideration in processing of hides. A high concentration of microbial cells not only destroys the hides but, to the people handling the hides, it can be a source of severe skin irritation and infection.

The present invention provides a composition which effectively preserves animal hides for extended periods of greater than 30 days.

The present invention further provides a composition which may be added to a float to maintain bacterial counts at acceptable levels.

This invention also provides a composition which has no significant adverse effect on the integrity of the hides.

Still further, this invention provides a hide preservative composition which avoids the use of salt.

DETAILED DESCRIPTION OF THE INVENTION

In accordance with this invention, a composition comprising propionic acid, sorbic acid, and preferably dehydroacetic acid and methyl paraben is prepared and used in an aqueous system to preserve freshly slaughtered animal hides. The composition includes, based on the weight of hides, from about 1.0% to about 2.0% propionic acid, and from about 0.4% to about 1.0% of ingredients comprising about 40 to about 100 parts sorbic acid, 0 to about 60 parts dehydroacetic acid and 0 to about 47 parts methyl paraben. Preferably, the composition includes, based on the weight of hides, from about 1.0% to about 1.5% propionic acid, and from about 0.4% to about 1.0% of ingredients comprising about 50 to about 80 parts sorbic acid, about 10 to about 50 parts dehydroacetic acid and about 10 to about 40 parts methyl paraben. All of the ingredients are commercially available.

The ingredients described above are mixed with water in an amount sufficient to result in a float of at least 10% and preferably about 10% to about 100%, based on the weight of hide to be preserved. Floats of above about 500% are normally impractical. A float is defined as the amount of water, based on hide weight, added to the hides to process hides into leather. For example, a 20% float for a 100 g. hide sample involves the addition of 20 grams of water to the hide. Addition of 100 g. or 500 g. of water to 100 g. hide samples results in a 100% or 500% float, respectively.

Other additives such as, for example, surfactants, may be used if desired. (Ethylenedinitrilo) tetraacetic acid tetrasodium salt is an example of a surfactant which may be used.

In accordance with this invention, hides are treated, i.e., soaked, and maintained in the soaked condition substantially until ready for processing, such as tanning.

The following examples are submitted for a better understanding of the invention.

EXAMPLES

Unwashed hide from freshly slaughtered calves is kept frozen until ready for testing. Pieces of hide are then allowed to warm to ambient temperature before soaking in the test formulation. Individual hide samples are placed in one-pint screw top jars. The formulations are added on a hide weight basis. Water is then added to create the percent float indicated. The jars are sealed, agitated 15 minutes to insure thorough mixing and stored at ambient temperatures. The hide samples are then checked at 7 days and 30 days for preservation. The course of preservation is monitored by noting visual mold or bacteria, odor, hair tightness, and bacterial count.

Microbial counts are determined in the following manner. To the jar containing the 100 g. hide samples are added 500 ml. of sterile water. The sample is agitated for ten minutes on a rotary shaker at 200 rpm. and the liquid is decanted into a sterile container. This procedure is repeated and serial dilutions then are made on the combined washes. Standard method agar plates are innoculated in duplicate for each dilution. Microbial colonies are counted after two to three days at room temperature.

Immediately after the hide samples are washed for bacterial counts they are submerged for three days in a 400% float containing 10% lime, 0.25% sodium sulfhydrate, and 0.25% sodium sulfide, and then examined for hair removal and grain damage.

In the examples, bacterial counts of less than $6\times10^4$ colonies are considered to be well preserved when tested at the indicated time period. The following abbreviations are used: NaDHA-sodium dehydroacetate; SA-sorbic acid; MP-methyl paraben; and DHA-dehydroacetic acid.

| Example No. | % Float | Solid Compounds Level | % Addition | Propionic Acid % Addition Level | Colonies/g Hide × $10^4$ 7 days | 30 days or longer |
|---|---|---|---|---|---|---|
| 1 | 0 | NaDHA | 1.0 | — | 1500 | —[a] |
| 2 | 20 | NaDHA | 0.5 | — | putrid | —[a] |
| 3 | 20 | NaDHA | 1.0 | — | putrid | —[a] |
| 4 | 20 | NaDHA | 1.0 | — | 2700 | —[a] |
| 5 | 500 | NaDHA | 1.0 | — | 330 | —[a] |
| 6 | 500 | NaDHA | 1.0 | — | putrid | —[a] |
| 7 | 20 | SA | 1.0 | — | putrid | —[a] |
| 8 | 20 | MP | 1.0 | — | putrid | —[a] |
| 9 | 20 | MP | 1.0 | — | 29 | —[a] |
| 10 | 20 | DHA | 0.1 | 1.0 | putrid | —[a] |
| 11 | 20 | DHA | 0.5 | 1.0 | 12 | —[a] |
| 12 | 20 | DHA | 0.5 | 1.0 | 1.3 | —[b] |
| 13 | 20 | DHA | 1.0 | 1.0 | 3.8 | —[b] |
| 14 | 20 | DHA | 1.0 | 1.0 | 1.9 | —[b] |
| 15 | 20 | NaDHA | 0.5 | 1.0 | 5.9 | 320 |
| 16 | 20 | NaDHA | 0.8 | 1.0 | 1.9 | 26 |
| 17 | 20 | NaDHA | 1.0 | 1.0 | 3.4 | 3.9 |
| 18 | 20 | NaDHA | 1.0 | 1.0 | 4.2 | 1.3 |
| 19 | 20 | MP | 0.5 | 1.0 | 180 | 110 |
| 20 | 20 | MP | 0.8 | 1.0 | 91 | 120 |
| 21 | 20 | MP | 1.0 | 1.0 | 0.6 | 0.8 |
| 22 | 20 | MP | 0.8 | 1.0 | 3.1 | 4.2 |
| 23 | 20 | SA | 0.5 | 1.0 | 1.9 | 4.6 |
| 24 | 20 | SA | 0.8 | 1.0 | 2.1 | 0.4 |
| 25 | 20 | SA | 1.0 | 1.0 | 3.6 | putrid |
| 26 | 20 | NaDHA:MP (50:50) | 0.5 | 1.0 | 330 | 140 |
| 27 | 20 | NaDHA:MP (50:50) | 0.8 | 1.0 | 250 | 17 |
| 28 | 20 | NaDHA:SA (50:50) | 0.5 | 1.0 | 2.8 | 1.3 |
| 29 | 20 | NaDHA:SA (50:50) | 0.8 | 1.0 | 0.4 | 0.3 |
| 30 | 20 | MP:SA (50:50) | 0.5 | 1.0 | 6.5 | 9.1 |
| 31 | 20 | MP:SA (50:50) | 0.8 | 1.0 | 1.5 | 6.8 |
| 32 | 20 | NaDHA:MP:SA (33.3:33.3:33.3) | 0.5 | 1.0 | 5.6 | 2.3 |
| 33 | 20 | NaDHA:MP:SA (33.3:33.3:33.3) | 0.8 | 1.0 | 7.2 | 5.4 |
| 34 | 20 | NaDHA:MP:SA (19.9:22.9:57.2) | 0.3 | 1.0 | putrid | —[a] |
| 35 | 20 | NaDHA:MP:SA (19.9:22.9:57.2) | 0.4 | 1.0 | 5.4 | —[b] |
| 36 | 20 | NaDHA:MP:SA (19.9:22.9:57.2) | 0.5 | 1.0 | 0.1 | —[b] |
| 37 | 20 | NaDHA | 1.0 | 1.0 | 1.8 | 2.8 |
| 38 | 50 | NaDHA | 1.0 | 1.0 | 0.8 | —[a] |
| 39 | 100 | NaDHA | 1.0 | 1.0 | 2.1 | 0.4 |
| 40 | 20 | MP | 1.0 | 1.0 | 2.0 | —[a] |
| 41 | 50 | MP | 1.0 | 1.0 | 1.8 | —[a] |
| 42 | 100 | MP | 1.0 | 1.0 | 0.8 | —[a] |
| 43 | 20 | SA | 1.0 | 1.0 | 1.0 | —[a] |
| 44 | 50 | SA | 1.0 | 1.0 | 1.2 | —[a] |
| 45 | 100 | SA | 1.0 | 1.0 | 1.9 | —[a] |
| 46 | 40 | SA:DHA:MP (30:40:30) | 0.4 | 1.0 | 0 | 0 |
| 47 | 60 | SA:DHA:MP (30:40:30) | 0.4 | 1.0 | 0.2 | 0.3 |
| 48 | 80 | SA:DHA-MP (30:40:30) | 0.4 | 1.0 | 0.1 | 0 |
| 49 | 40 | SA:DHA:MP (30:40:30) | 0.4 | 1.0 | 4.1 | 0.1 |
| 50 | 60 | SA:DHA:MP (30:40:30) | 0.4 | 1.0 | 0.1 | 0.2 |
| 51 | 100 | SA:DHA:MP (30:40:30) | 0.4 | 1.0 | 0.1 | 0 |
| 52 | 20 | SA | 0.1 | 1.0 | 73 | —[a] |
| 53 | 20 | SA | 0.1 | 1.5 | 3.7 | —[a] |

-continued

| Example No. | % Float | Solid Compounds Level | % Addition | Propionic Acid % Addition Level | Colonies/g Hide × $10^4$ 7 days | 30 days or longer |
|---|---|---|---|---|---|---|
| 54 | 20 | SA | 0.1 | 2.0 | 2.0 | 0.1 |
| 55 | 20 | SA | 0.2 | 1.0 | 1.1 | —[a] |
| 56 | 20 | SA | 0.2 | 1.5 | 1.3 | —[a] |
| 57 | 20 | SA | 0.2 | 2.0 | 1.1 | 0 |
| 58 | 20 | SA | 0.3 | 1.0 | 3.7 | —[a] |
| 59 | 20 | SA | 0.3 | 1.5 | 0.1 | 0.1 |
| 60 | 20 | SA | 0.3 | 2.0 | 0.9 | 0.1 |
| 61 | 20 | SA:DHA (50:50) | 0.1 | 1.0 | 13 | —[a] |
| 62 | 20 | SA:DHA (50:50) | 0.1 | 1.5 | 35 | —[a] |
| 63 | 20 | SA:DHA (50:50) | 0.1 | 2.0 | 0.8 | 0.2 |
| 64 | 20 | SA:DHA (50:50) | 0.2 | 1.0 | 0.5 | —[a] |
| 65 | 20 | SA:DHA (50:50) | 0.2 | 1.5 | 0.4 | 0.2 |
| 66 | 20 | SA:DHA (50:50) | 0.2 | 2.0 | 0.6 | 0.2 |
| 67 | 20 | SA:DHA (50:50) | 0.3 | 1.0 | 0 | 0 |
| 68 | 20 | SA:DHA (50:50) | 0.3 | 1.5 | putrid | —[a] |
| 69 | 20 | SA:DHA (50:50) | 0.3 | 2.0 | 53 | —[a] |
| 70 | 20 | SA:DHA:MP (60:20:20) | 0.1 | 1.0 | 0.4 | —[a] |
| 71 | 20 | SA:DHA:MP (60:20:20) | 0.1 | 1.5 | 2.7 | —[a] |
| 72 | 20 | SA:DHA:MP (60:20:20) | 0.1 | 2.0 | 0.6 | 1.1 |
| 73 | 20 | SA:DHA:MP (60:20:20) | 0.2 | 1.0 | 2.2 | —[a] |
| 74 | 20 | SA:DHA:MP (60:20:20) | 0.2 | 1.5 | 0 | 0.1 |
| 75 | 20 | SA:DHA:MP (60:20:20) | 0.2 | 2.0 | 0.6 | 0.2 |
| 76 | 20 | SA:DHA:MP (60:20:20) | 0.3 | 1.0 | putrid | —[a] |
| 77 | 20 | SA:DHA:MP (60:20:20) | 0.3 | 1.5 | 81 | —[a] |
| 78 | 20 | SA:DHA:MP (60:20:20) | 0.3 | 2.0 | 3.2 | 0.4 |
| 79 | 20 | SA:DHA:MP (30:40:30) | 0.1 | 1.0 | putrid | —[a] |
| 80 | 20 | SA:DHA:MP (30:40:30) | 0.1 | 1.5 | 53 | —[a] |
| 81 | 20 | SA:DHA:MP (30:40:30) | 0.1 | 2.0 | 0.3 | —[a] |
| 82 | 20 | SA:DHA:MP (30:40:30) | 0.2 | 1.0 | putrid | —[a] |
| 83 | 20 | SA:DHA:MP (30:40:30) | 0.2 | 1.5 | putrid | —[a] |
| 84 | 20 | SA:DHA:MP (30:40:30) | 0.2 | 2.0 | 11 | —[a] |
| 85 | 20 | SA:DHA:MP (30:40:30) | 0.3 | 1.0 | putrid | —[a] |
| 86 | 20 | SA:DHA:MP (30:40:30) | 0.3 | 1.5 | 5.7 | —[c] |
| 87 | 20 | SA:DHA:MP (30:40:30) | 0.3 | 2.0 | 1.9 | 0.1 |
| 88 | 20 | SA:DHA:MP (30:40:30) | 0.4 | 1.0 | 0.9 | —[c] |
| 89 | 20 | SA:DHA:MP (30:40:30) | 0.4 | 1.5 | 1.1 | —[c] |
| 90 | 20 | SA:DHA:MP (30:40:30) | 0.4 | 2.0 | 1.6 | 0.9 |
| 91 | 20 | — | — | 0.5 | putrid | —[a] |
| 92 | 20 | — | — | 1.0 | 1.1 | putrid |
| 93 | 20 | — | — | 1.5 | 1.6 | putrid |
| 94 | 20 | — | — | 2.0 | 0.5 | —[c] |

[a]Sample becomes putrid prior to 30 day test.
[b]No 30 day data.
[c]No data but hide is still in good condition after 5–½ weeks.

The term "dehydroacetic acid" as used herein is intended to include its salts, such as sodium, potassium, ammonium and calcium dehydroacetate.

Unless otherwise specified, all percentages, ratios, parts, etc., are on a weight basis.

The invention has been described in detail with particular reference to certain preferred embodiments thereof, but it will be understood that variations and modifications can be effected within the spirit and scope of the invention.

I claim:

1. A composition for preserving animal hides in aqueous float comprising, based on the weight of hides, from about 1.0 to about 2.0% propionic acid, and from about 0.4% to about 1.0% sorbic acid.

2. A composition according to claim 1 comprising from about 1.0 to about 1.5% propionic acid.

3. A composition for preserving animal hides in aqueous float comprising, based on the weight of hides, from about 1.0 to about 2.0% propionic acid, and from about 0.4% to about 1.0% of a substance comprising about 40 to about 100 parts sorbic acid and from about 1 to about 60 parts dehydroacetic acid.

4. A composition for preserving animal hides in aqueous float comprising, based on the weight of hides, from about 1.0 to about 2.0% propionic acid, and from about 0.4% to about 1.0% of a substance comprising about 40 to about 100 parts sorbic acid and from about 1 to about 47 parts methyl paraben.

5. A composition for preserving animal hides in aqueous float comprising, based on the weight of hides, from about 1.0 to about 1.5% propionic acid, and from about 0.4% to about 1.0% of a substance comprising about 40 to about 100 parts sorbic acid, about 1 to about 60 parts dehydroacetic acid, and about 1 to about 47 parts methyl paraben.

6. A composition for preserving animal hides in aqueous float comprising, based on the weight of hides, from about 1.0 to about 1.5% propionic acid, and from about 0.4% to about 1.0% of a substance comprising about 50 to about 80 parts sorbic acid, about 10 to about 50 parts dehydroacetic acid, and about 10 to about 40 parts methyl paraben.

7. A method of preventing animal hides from deteriorating comprising soaking said hides in the composition defined in claim 1.

8. A method of preventing animal hides from deteriorating comprising soaking said hides in the composition defined in claim 2.

9. A method of preventing animal hides from deteriorating comprising soaking said hides in the composition defined in claim 3.

10. A method of preventing animal hides from deteriorating comprising soaking said hides in the composition defined in claim 4.

11. A method of preventing animal hides from deteriorating comprising soaking said hides in the composition defined in claim 5.

12. A method of preventing animal hides from deteriorating comprising soaking said hides in the composition defined in claim 6.

* * * * *